United States Patent [19]

Kochevar

[11] Patent Number: 4,502,687

[45] Date of Patent: Mar. 5, 1985

[54] GOLF CLUB HEAD AND METHOD OF WEIGHTING SAME

[76] Inventor: Rudolph J. Kochevar, 638 W. Duarte Rd., Suite 19, Arcadia, Calif. 91006

[21] Appl. No.: 497,424

[22] Filed: May 24, 1983

[51] Int. Cl.[3] ..... A63B 53/08

[52] U.S. Cl. ..... 273/171; 273/167 H

[58] Field of Search ..... 273/167 H, 171, 170, 273/169, 172, 162 R, 162 B, 77 R; 272/122, 123

[56] References Cited

U.S. PATENT DOCUMENTS

| | | | |
|---|---|---|---|
| 1,529,009 | 3/1925 | Carpenter | 273/171 X |
| 3,356,782 | 12/1967 | Whyte | 273/171 X |
| 4,010,958 | 3/1977 | Long | 273/169 |
| 4,220,336 | 9/1980 | Kochevar | 273/169 X |
| 4,313,607 | 2/1982 | Thompson | 273/167 H |

FOREIGN PATENT DOCUMENTS

| | | | |
|---|---|---|---|
| 211781 | 1/1957 | Australia | 273/169 |

*Primary Examiner*—George J. Marlo

*Attorney, Agent, or Firm*—Gordon L. Peterson

[57] ABSTRACT

A method of weighting a hollow golf club head having a wall defining an interior chamber and a hosel leading to such chamber comprising providing an adhesive weight composition of the desired weight at an elevated temperature within the chamber with the composition being flowable at such elevated temperature and cooling the adhesive weight composition to a solid state to strongly adhere the weight compostion to the wall of the chamber to such an extent that the adhesive weight composition is not likely to release from the wall during normal use of the golf club head. The adhesive weight composition preferably includes a sticky adhesive composition and particulate material.

19 Claims, 5 Drawing Figures

GOLF CLUB HEAD AND METHOD OF WEIGHTING SAME

BACKGROUND OF THE INVENTION

Golf club heads are typically constructed of metal and must be manufactured to precisely the correct weight. Golf club heads are typically metal castings which are appropriately finished to provide the desired club head contour and finish. Controlling the weight of the casting is very difficult due to shrinkage and variations in the pattern thickness. In addition, the process of finishing the casting removes varying amounts of material from the golf club heads. For these reasons, golf club heads, at this stage of production, are not at the correct weight.

Many golf club heads, such as metal woods, are hollow and have a wall which defines an interior chamber and a hosel leading to the chamber. It is customary to fill the chamber with foam plastic after finishing of the casting. This adds weight but, in many cases, not a sufficient amount to bring the club head to the desired weight.

To increase the amount of weight added to the club head, particulate material, such as silica sand or lead filings, are introduced into the chamber through the hosel prior to the introduction of the foam plastic. Before the foam plastic cures, the club head is agitated in an attempt to distribute the particles throughout the foam. Unfortunately, many of the particles do not become trapped in the foam and rattle. In addition, the relatively heavy particles which are trapped in the foam tend to break loose during use of the club head. Also, some of the particles may be trapped within a relatively large void within the foam plastic. All of these loose particles within the club head rattle during use, and this may cause the club to be returned to the manufacturer. Finally, it is not possible to control the distribution of weight inside the club head using this technique.

Attempts have also been made to weight a golf club head with an epoxy adhesive. However, the epoxy is very difficult and messy to inject, and it is somewhat difficult to accurately control the weight of the epoxy which is injected. Furthermore, after curing, the epoxy becomes very hard and brittle and tends to break off and rattle inside the club head.

SUMMARY OF THE INVENTION

This invention provides a method of weighting a golf club head which generally overcomes the problems noted above. With this invention, the weight of the club and the distribution of the weight within the club can be accurately controlled. In addition, the weight introduced into the club head will not come loose and rattle.

This invention utilizes an adhesive weight composition which is capable of strongly adhering to the wall of the chamber within the golf club head. The adhesive quality of the weight composition is such that the adherence to the wall of the chamber occurs to such an extent that the weight composition will not release from the wall during normal use of the golf club head.

Unlike an epoxy which is hard and brittle, the weight composition of this invention is pliable when it is in the solid state. The preferred weight composition is somewhat soft and gel-like. Because of these physical properties, the weight composition can flex somewhat upon impact and, for this reason, is much less likely to separate from the wall to which it is adhered than the hard, brittle epoxy. In addition, the pliability of the weight composition causes it to dampen vibrations occurring on impact of a golf club head and a golf ball and attenuates the sound thus produced.

The weight composition is preferably flowable at a temperature to which the golf club head can be safely subjected. This permits the weight composition to flow into the minute crevices of the golf club head and help bring about a strong adherence to the golf club head.

According to the method of this invention, the weight composition of the desired weight is provided at an elevated temperature within the chamber of the golf club head. The temperature is elevated sufficiently so that the weight composition is flowable. The weight composition is then cooled to a solid state to bring about the strong adherence of the weight composition to the wall of the chamber referred to above.

The weight composition is in a solid state at normal ambient temperature and the weight composition is preferably introduced through the hosel into the chamber in the solid state. The weight composition can be introduced into the chamber in the flowable state; however, the process is safer and easier to control by introducing the weight composition into the chamber in the solid state.

Thereafter, the golf club head with the weight composition therein is heated to an elevated temperature to render the weight composition flowable. This causes the weight composition to flow into the minute crevices in the wall of the chamber so that upon cooling, it can form a more intimate bond with the golf club head. In addition, by appropriately positioning the club head in the desired position, the flowable weight composition will flow under the influence of gravity to the desired location within the chamber so that the placement of the weight within the chamber can be accurately controlled.

Although the method and weight composition of this invention can be used to weight many different golf club heads, it is particularly adapted for weighting a metal golf club head in which the chamber extends throughout the head, such as metal woods. In this event, the volume of the weight composition in the chamber is normally substantially less than the volume of the chamber, and there is a gap between a major region of the weight composition and the wall of the chamber. With this invention, this gap may be filled or partially be filled with a foam plastic or the gap may be left empty.

The adhesive weight composition may be of any material which will strongly adhere to the wall of the chamber of the golf club head to such an extent that the weight will not release from the wall during normal use of the golf club head. Of course, the weight composition must be capable of adding the required weight, and for the method of this invention, the weight composition should be flowable at elevated temperatures. A preferred weight composition comprises an adhesive composition with or without a particulate material. The particulate material is preferably of greater density than the adhesive composition, which forms a binder for the particles. For example, the particulate material may be sand or particulate metal, such as powdered lead, powdered iron or powdered copper. The particulate material is present in an amount from 0 percent to about 93 percent by weight and the adhesive composition is present in an amount of from about 7 percent to about 100 percent by weight. In a preferred weight composition, the adhesive composition is present in an amount of about 13 percent by weight and the particulate material is present in an amount of about 87 percent by weight.

The adhesive composition should become sufficiently flowable at temperatures no greater than about 500 degrees F., which may be considered as the melting point. Generally, the adhesive weight composition is sufficiently flowable if it has a viscosity similar to that of honey at normal room temperature. If the weight composition does not become flowable at or below this temperature, the temperatures involved could damage the golf club head. The adhesive composition should not have a melting point or become flowable at any reasonable temperature to which the golf club head may be subjected following its manufacture. Generally, the melting point should not be less than 230 degrees F. In addition, the adhesive composition should be pliable in the solid state.

Any adhesive composition meeting the physical requirements defined above, can be employed. For example, tar and/or various tar-like adhesives could be employed.

The preferred adhesive composition includes sticky, adhesive components. In a preferred adhesive composition, polyisobutylene and petroleum hydrocarbon resins are both used. The polyisobutylene should be present in an amount from about 20 percent to about 75 percent by weight. Good results can be obtained with about 48 to about 68 percent by weight of polyisobutylene. At least 20 percent polyisobutylene is required for the desired adhesiveness but if over 75 percent by weight of polyisobutylene is used, the adhesive composition is too flowable. The petroleum hydrocarbon resins provide tackiness at elevated temperatures and should be present in an amount from about 5 percent to about 50 percent. Good results can be obtained with about 9 to about 19 percent by weight of petroleum hydrocarbon resins. If less than 5 percent of the hydrocarbon resins are used, the composition does not have the desired tackiness at high temperatures, and if more than 50 percent is used, the composition becomes too brittle.

The adhesive weight composition also preferably includes a viscosity stabilizer, such as polybutene. Polybutene is preferred because it is also a sticky, tacky substance. The polybutene is present in an amount from about 0 percent to about 20 percent by weight. If more than 20 percent of polybutene is used, the composition does not set hard enough in the solid state.

The preferred adhesive composition also includes plasticizers, and mineral oil and hexane are preferably both employed as plasticizers. Each of these is present in amount from about 0 percent to about 10 percent by weight. If more than 10 percent of either of these plasticizers is used, the composition may not have the desired adhesiveness.

The adhesive composition also preferably includes a stabilizer, and beeswax is the preferred stabilizer. Beeswax is preferably present in amount from about 0 percent to about 50 percent by weight. If more than 50 percent beeswax is used, the composition is too hard.

The invention, together with additional features and advantages thereof, may best be understood by reference to the following description taken in connection with the accompanying illustrative drawing.

DESCRIPTION OF THE PREFERRED EMBODIMENT

Figure 1:
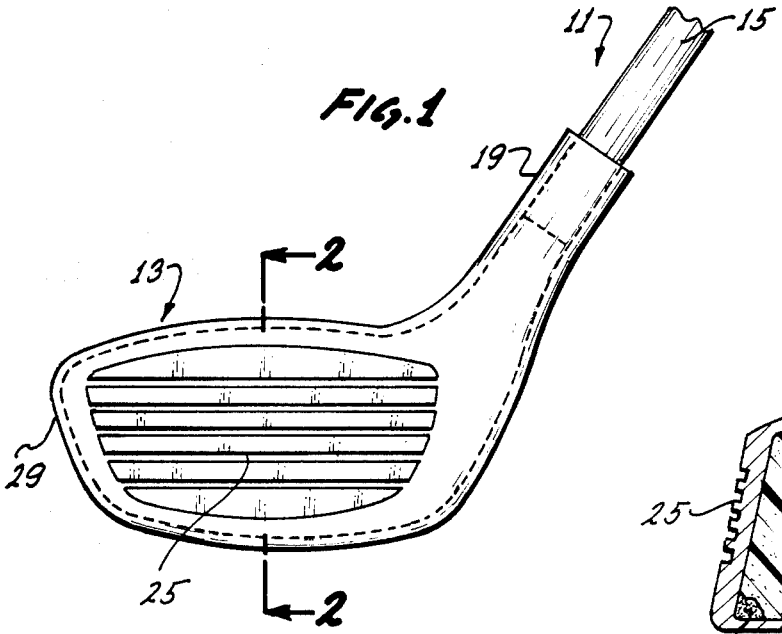
FIG. 1 is a fragmentary front elevational view of a golf club constructed in accordance with the teachings of this invention.

FIG. 1 shows a golf club 11 which comprises a weighted golf club head 12 and a shaft 15. The weighted golf club head 12 comprises a golf club head 13 which is constructed of metal and has an interior chamber 17 (FIG. 3) which extends throughout the club head and a hosel 19 leading to the chamber. The shaft 15 is retained within the hosel 19 in a conventional manner.

More specifically, the club head 13 has a top wall 21, a bottom wall 23, a face or front wall 25 which is adapted to hit a golf ball, a back wall 27 and a toe or outer wall 29. These walls cooperate to define the chamber 17.

Figure 2:
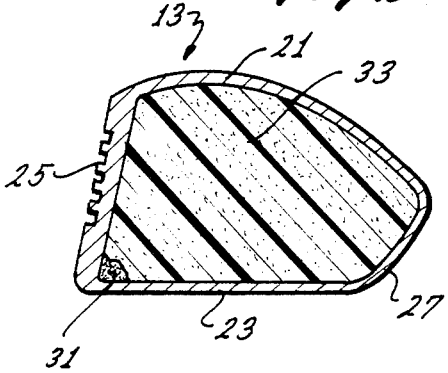
FIG. 2 is a sectional view taken generally along line 2—2 of FIG. 1.

An adhesive weight composition 31 is strongly adhered by its own adhesive qualities to the club head 13. The weight composition 31 has precisely the necessary weight to bring the club head 13 to the desired weight and is pliable. The weight composition 31 is within the chamber 17 and is adhered to a location of the wall of the club head 13 to provide the weight at the desired location. By way of example, in the construction shown in FIG. 2, the weight composition 31 is located along the juncture of the bottom wall 23 and the face 25 and is elongated to provide a large area of contact with these walls to aid in strongly adhering it to both of these walls. The weight composition fills only a very small portion of the chamber 17 and a major length of the weight composition is spaced from the wall by a gap which, in the embodiment illustrated, is filled with polyurethane foam 33 (FIG. 2).

Figure 3:
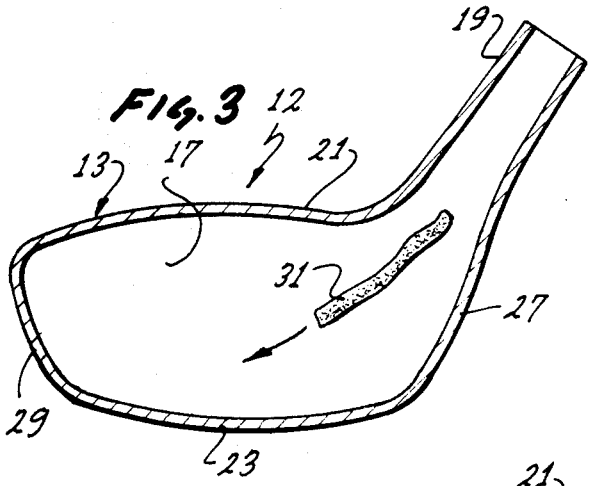
FIG. 3 is a sectional view taken on an axial plane through a hollow golf club head and illustrating the insertion of the weight composition.
Figure 5:
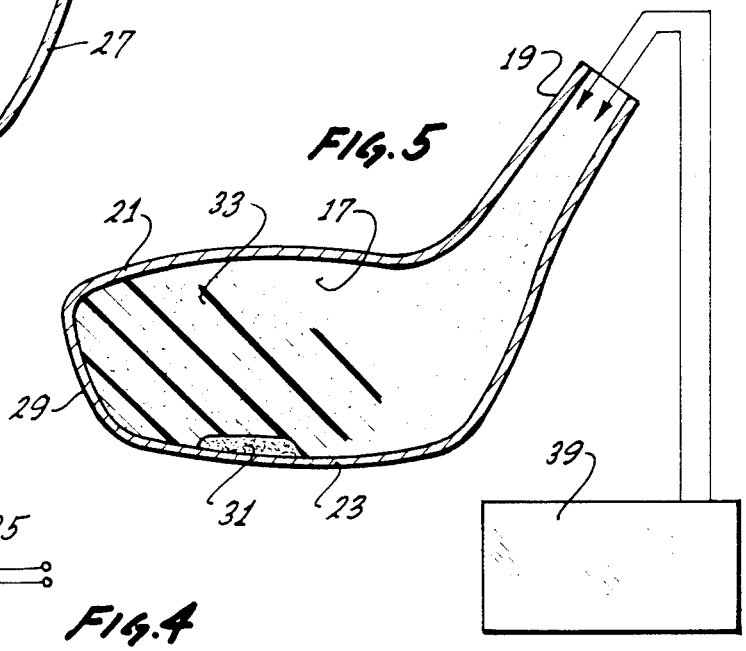
FIG. 5 is a sectional view similar to FIG. 4 showing the introduction of materials to provide foam plastic within the golf club head.
Figure 4:
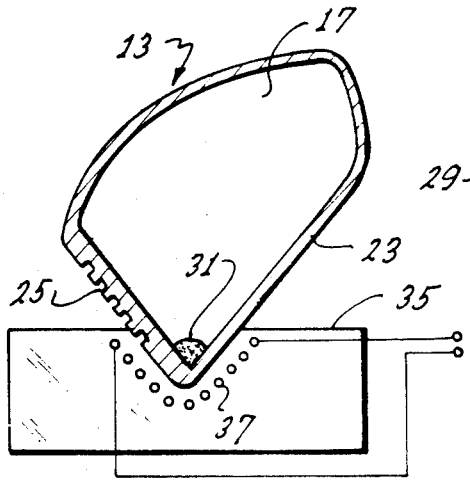
FIG. 4 is a partially schematic sectional view showing the heating of the golf club head and weight composition.

FIGS. 3–5 illustrate a preferred method of weighting the golf club head 13 to provide the weighted golf club head 12. In the form shown in FIG. 3, the golf club head 13 is in the form of a metal casting which has been appropriately finished and polished so that it is ready for weighting. First, the correct amount of the weight composition 31 is introduced through the hosel 19 into the chamber 17. The weight composition is roughly positioned within the chamber 17 by appropriately positioning the club head 13 and striking the club head against a surface so that the inertia of the weight composition 31 will roughly position the weight composition within the chamber. This is necessary because the weight composition 31 is extremely sticky and, like adhesive tape, tends to stick to whatever it is placed against.

Next, the club head 13 is placed in a fixture 35 which is adapted to hold the club head in the desired position, and the club head and the weight composition 31 are heated by an oven or, as shown in the drawing, by a heater 37 which may be integral with the fixture. The heater 37 heats the club head 13 and the weight composition 31 to an elevated temperature which is no more than 500 degrees F. and which is sufficient to cause the weight composition 31 to become flowable. For the particular weight composition suggested in the specific embodiment, the weight composition may be heated, for example, to about 300° F. This causes the weight composition 31 to flow with about the viscosity of honey into intimate contact with the adjacent surfaces of the bottom wall 23 and the face 25 and further tends to enhance the stickiness of the weight composition. Moreover, the flowing of the weight composition 31 assists with the final positioning of the weight composition within the chamber 17.

After a period of about twelve to thirty minutes at an elevated temperature, the club head 13 and the weight composition 31 are allowed to cool, either on the fixture 35 or elsewhere. This allows the weight composition to return to a solid state in which it is pliable and bring about the strong adherence of the weight composition to the bottom wall 23 and the face 25 as described above.

Finally, the material necessary for forming the polyurethane foam 33 is introduced into the chamber 17 through the hosel 19 from a conventional apparatus 39 as shown in FIG. 5. Of course, the foam may be of a material other than polyurethane. In addition, the foam 33 may be eliminated entirely, if desired.

The weighted golf club head 12 can then be attached to the shaft 15. If the golf club 11 then requires further weight adjustment, this can be accomplished in accordance with my U.S. Pat. No. 4,220,336.

The preferred weight composition 31 utilizes 13 percent by weight of an adhesive composition and about 87 percent by weight of powdered lead. The preferred adhesive composition comprises several components suitably mixed together and preferably has the following composition:

| Ingredients | Percent by Weight |
|---|---|
| polyisobutylene | 58 percent |
| polybutene | 9 percent |
| mineral oil | 6 percent |
| hexane | 6 percent |
| beeswax | 7 percent |
| petroleum hydrocarbon resins | 14 percent |

Although an exemplary embodiment of the invention has been shown and described, many changes, modifications and substitutions may be made by one having ordinary skill in the art without necessarily departing from the spirit and scope of this invention.

I claim:

1. A method of weighting a hollow golf club head having a wall defining an interior chamber and a hosel leading to such chamber, said method comprising:

introducing a weight composition of the desired weight in a solid state into the chamber with the weight composition being sticky in the solid state;

heating the club head and weight composition to an elevated temperature to render the weight composition flowable and to enhance the stickiness of the weight composition; and cooling the weight composition to a solid state to strongly adhere the weight composition to the wall of the chamber to such an extent that the weight composition is not likely to release from the wall during normal use of the golf club head.

2. A method as defined in claim 1 wherein the weight composition is pliable in the solid state.

3. A method as defined in claim 1 wherein the volume of the weight composition in said chamber is less than the volume of the chamber.

4. A method as defined in claim 3 including providing a foam plastic material in the chamber.

5. A method as defined in claim 1 wherein the interior chamber extends substantially throughout the golf club head and said wall includes a bottom wall and said step of providing includes providing the weight composition on said bottom wall.

6. A method as defined in claim 1 including positioning the club head in a first position so that the weight composition in its flowable state will flow under the influence of gravity to the desired location within the chamber and cooling the weight composition with the club head in said first position.

7. A method as defined in claim 6 wherein the weight composition is pliable in the solid state and includes particulate material and a sticky adhesive composition and wherein the volume of the weight composition in said chamber is less than the volume of said chamber.

8. A method as defined in claim 1 wherein the weight composition includes particulate material and a binder and is at least somewhat pliable in the solid state.

9. A method as defined in claim 1 wherein said step of introducing includes introducing the weight composition through the hosel into the chamber.

10. A method as defined in claim 1 wherein said step of heating is carried out to heat the weight composition to a temperature no greater than about 500 degrees F. and no less than about 230 degrees F.

11. A weighted golf club head comprising:

a hollow golf club head having a wall defining an interior chamber which extends throughout said head and a hosel leading to the chamber;

an adhesive weight composition which is sticky in the solid state and cured in situ, said weight composition being strongly adhered by the adhesive quality of the weight composition to the wall of the chamber to such an extent that the weight composition is not likely to release from the wall during normal use of the golf club head;

the volume of the weight composition in the chamber being less than the volume of the chamber whereby there is a gap between a major region of the weight composition and the wall of the chamber; and the weight composition being at least somewhat pliable in the solid state.

12. A weighted golf club head as defined in claim 11 including foam plastic filling at least a major portion of said gap in said chamber.

13. A weighted golf club head as defined in claim 11 wherein said weight composition comprises particulate material dispersed in a sticky adhesive composition.

14. A weighted golf club head as defined in claim 11 wherein said weight composition consists essentially of about 7 percent to about 100 percent by weight of an adhesive composition and from about 0 percent to about 93 percent by weight of a particulate material dispersed in the adhesive composition, said particulate material having a greater density than the adhesive composition, and said adhesive composition having a melting point between about 230 degrees F. and 500 degrees F.

15. A weighted golf club head as defined in claim 14 wherein said adhesive composition consists essentially of from about 20 percent to about 75 percent by weight of polyisobutylene, from 0 percent to about 20 percent by weight of polybutene, from 0 percent to about 10 percent by weight of mineral oil, from 0 percent to about 10 percent by weight of hexane, from 0 percent to about 50 percent by weight of beeswax, and from about 5 percent to about 50 percent by weight of petroleum hydrocarbon resins.

16. A weighted golf club head as defined in claim 15 wherein the polyisobutylene is present in the range of about 48 percent to 68 percent by weight and the petroleum hydrocarbon resins are present in the range of from about 9 percent to about 19 percent by weight.

17. A weighted golf club head as defined in claim 16 wherein the adhesive composition represents about 13 percent by weight of the adhesive weight composition.

18. A weighted golf club head as defined in claim 15 wherein the components of the adhesive composition are present in the following percents by weight of the adhesive composition:

| | |
|---|---|
| polyisobutylene | 58 percent |
| polybutene | 9 percent |
| mineral oil | 6 percent |
| hexane | 6 percent |
| beeswax | 7 percent |
| petroleum hydrocarbon | 14 percent |

19. A method of weighting a hollow golf club head having a wall defining an interior chamber and a hosel leading to such chamber, said method comprising:

introducing a weight composition of the desired weight in a solid state into the chamber with the weight composition comprising a sticky adhesive composition and particulate material in the sticky adhesive composition;

heating the golf club head and weight composition to an elevated temperature to render the weight composition flowable; and cooling the weight composition to a solid state to strongly adhere the weight composition to the wall of the chamber to such an extent that the weight composition is not likely to release from the wall during normal use of the golf club head.

* * * * *